US007024806B2

(12) United States Patent
Suzik et al.

(10) Patent No.: US 7,024,806 B2
(45) Date of Patent: Apr. 11, 2006

(54) AUXILIARY ASSEMBLY FOR REDUCING UNWANTED MOVEMENT OF A HOIST ROPE

(75) Inventors: Jason E. Suzik, Waukesha, WI (US); Thomas P. Weber, Glendale, WI (US)

(73) Assignee: Harnischfeger Technologies, Inc., Wilmington, DE (US)

( * ) Notice: Subject to any disclaimer, the term of this patent is extended or adjusted under 35 U.S.C. 154(b) by 151 days.

(21) Appl. No.: 10/755,808

(22) Filed: Jan. 12, 2004

(65) Prior Publication Data

US 2005/0150141 A1 Jul. 14, 2005

(51) Int. Cl.
*E02F 5/02* (2006.01)
*E02F 9/14* (2006.01)

(52) U.S. Cl. ..... 37/396; 37/397

(58) Field of Classification Search ..... 37/394–401; 254/393–399, 389

See application file for complete search history.

(56) References Cited

U.S. PATENT DOCUMENTS

| | | | | |
|---|---|---|---|---|
| 3,708,152 | A * | 1/1973 | Bulin | 254/327 |
| 3,959,899 | A * | 6/1976 | Rangaswamy | 37/397 |
| 4,027,969 | A | 6/1977 | Foxell | |
| 5,123,607 | A * | 6/1992 | Jones | 242/420.6 |
| 6,067,735 | A | 5/2000 | Kallenberger | 37/397 |

FOREIGN PATENT DOCUMENTS

| | | | | |
|---|---|---|---|---|
| DE | 2642910 | A1 * | 3/1978 | 37/397 |

* cited by examiner

*Primary Examiner*—Christopher J. Novosad
(74) *Attorney, Agent, or Firm*—James Earl Lowe, Jr.

(57) ABSTRACT

An auxiliary hoist sheave assembly comprising a sheave support frame, a mechanism for mounting the sheave support frame to a boom, a lower sheave shaft mounted on the sheave support frame, and a grooved hoist sheave, rotatably supported by and slidable along the lower sheave shaft, the hoist sheave being in contact with a hoist rope, and the hoist sheave fleeting side to side along the lower sheave shaft as the hoist rope follows the hoist drum.

9 Claims, 3 Drawing Sheets

AUXILIARY ASSEMBLY FOR REDUCING UNWANTED MOVEMENT OF A HOIST ROPE

BACKGROUND OF THE INVENTION

This invention relates to mining equipment utilizing hoist or wire rope or ropes and, more particularly, to auxiliary assemblies for reducing unwanted movement of a hoist rope of a mining machine.

BACKGROUND OF THE INVENTION

Large mining machines accomplish the task of digging through a bank by suspending a bucket or dipper on steel hoist ropes that pass over steel sheaves mounted at the tip of a stationary boom. The ropes then connect to and wrap around a hoist drum mounted to the revolving frame structure. The hoist drum is motor driven through a gearbox attached to the revolving frame. Rotation of the drum in one direction hoists the dipper through the bank. Rotation of the drum in the opposite direction allows the dipper to be lowered.

During both of these operations, but specifically while under heavy load during the digging/hoisting operation, the rope span between the hoist drum and boom point sheaves can move up or down or side to side, i.e., vibrate significantly due to pulsations in axial load. Further, electric mining shovels frequently encounter situations that result in the dipper impacting something that causes stress in the hoist rope. The span can vibrate as much as six to twelve inches above and below the straight line of sight path from drum to sheave. This vibration induces bending stresses in the portion of the rope that is leaving contact with the drum. Because the vibration occurs during the dig portion of the cycle, the ropes are under the highest axial load that they will see. This forces the magnitude of the bending stresses due to the rope vibration to be high as well. These bending stresses are concentrated in the outer main strands of the rope. The repeated effect of these bending stresses due to the vibration of the rope span can fatigue the rope and eventually result in broken wires in the outside layers of the rope.

This bending fatigue in the wire rope results from rubbing between the wires in the rope main strands and the outer wires of the center strand. This rubbing eventually causes the wires to break. If a significant amount of the wires break, there may not be enough strength remaining to support the applied load. This can result in rope failure. Because many of the wire breaks may occur inside the wire rope and are unseen and difficult to detect by other means, the failure can come as a surprise.

Electric mining shovel hoist ropes can be taken out of service for many reasons. Some of these may be because the ropes are damaged due to impact or abrasion near the dipper; there is reduced rope diameter due to wear or loss of core support; there is corrosion near the end supports of the rope; or there are a number of broken wires in the outer layers of the rope. This last criterion is a very common reason for electric mining shovel hoist ropes to be removed from service. The typical location of the broken wires occurs in the portion of the rope length that leaves contact with the hoist drum during the operating cycle of the shovel. This is the failure mechanism that this invention is trying to combat.

One typical approach to increase hoist rope life is to increase the rope diameter in order to increase the overall strength of the rope. This increase in diameter can help to lengthen rope life, but the increase in diameter has limitations. Small increases in diameter, ⅛ inch (0.3 cm) or less, can sometimes be accommodated with the existing drum and sheave grooving, but this small increase alone will likely not have a profound effect on rope life. Larger increases require larger drum grooving and possibly increased groove pitch spacing. This increased pitch spacing can then lead to the necessity of a longer or larger diameter hoist drum.

Some current shovels include a mechanism in order to prevent the rope span from colliding with and damaging the boom handrails or other items attached to the boom. The mechanism is a steel frame, like a picture frame, attached to the boom, through which the hoist ropes pass. In another similar structure, the steel frame has adjustable upper and lower guides that constrain the movement of the hoist ropes, both the upper and lower guides have nylon rollers thereon. In some instances, the lower guide has been positioned close to the hoist ropes, but no attempt is made to reduce vibration by positioning the guide in constant contact with the hoist rope.

SUMMARY OF THE INVENTION

One of the principle features of the invention is the provision of an auxiliary hoist rope sheave assembly that supports the hoist rope near the mid-span of the boom in order to limit vibration of the rope span. By limiting the hoist rope vibration, rope bending stresses due to vibration are significantly reduced.

Another of the principle features of the invention is the providing of an improved electric mining shovel with increased hoist rope life, thus increasing the time between hoist rope change outs without the more typical and very costly approaches of increasing rope diameter or the rope winding drum diameters.

Another of the principle features of the invention is to reduce the length of the typical electric mining shovel rope span, and thus reduce the amount of vibration typically seen by the rope. By providing a support in the middle of the span, the typical span is replaced by two shorter segments.

The assembly includes a welded, tubular frame that is pin-mounted to the shovel boom structure. Housed within this frame are two steel shafts. The lower shaft houses two dual-grooved sheaves that fleet side-to-side as the hoist ropes follow the drum grooving. The upper shaft houses two split, nylon rollers that help to contain the ropes within the sheaves and to keep them from jumping out of the grooves. Two adjustable, turnbuckle-style, struts are employed to support the frame and to provide a means of adjusting the height of the sheaves. Changing the height of the sheaves allows for adjusting the amount of deflection of the hoist ropes from the direct line-of-sight path from the drum to the boom point sheave. The mechanism provides intimate contact with the hoist ropes and has the capability to preload or not to preload the rope span.

Figure 1:
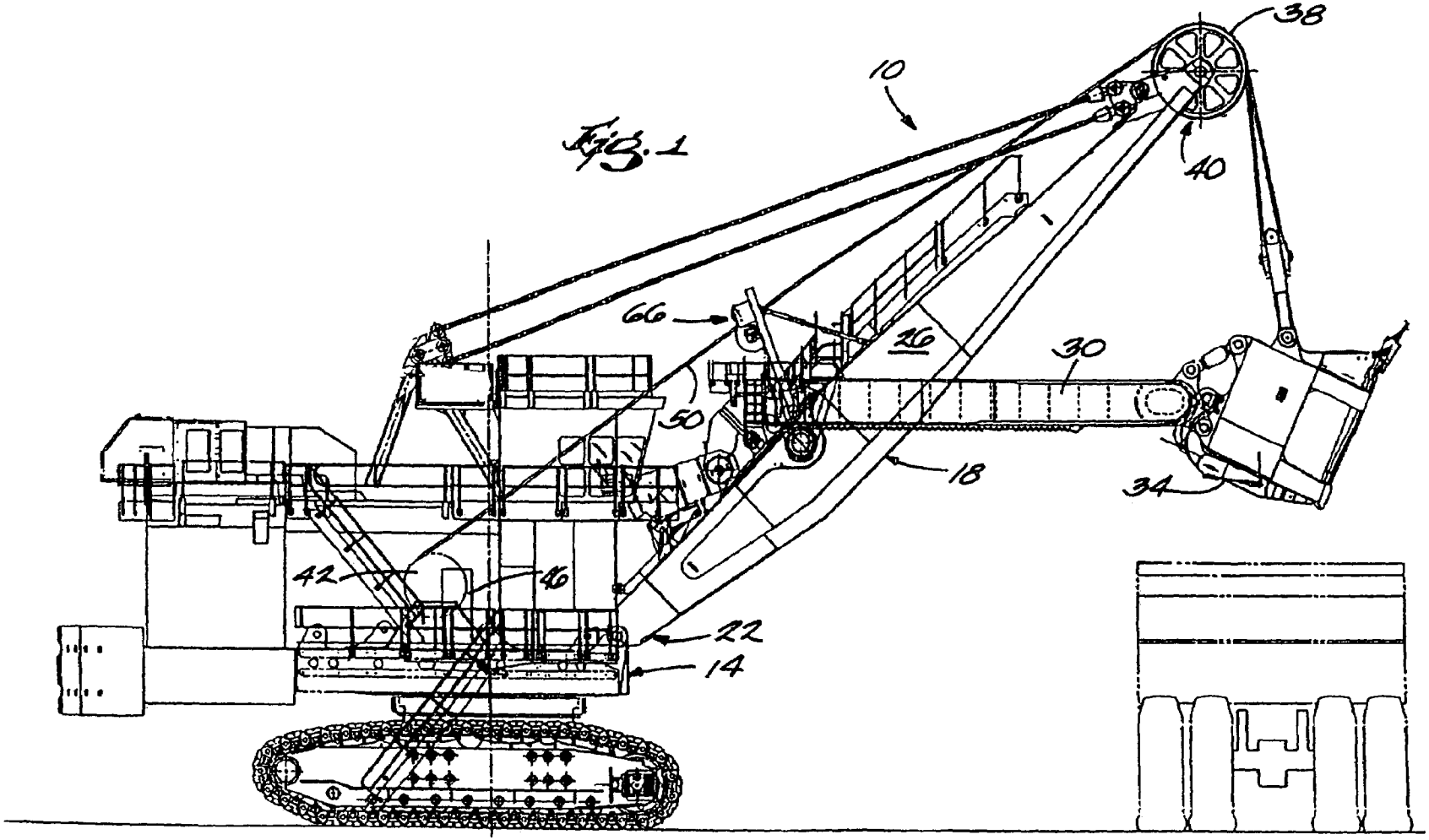
FIG. 1 is a side view of an electric shovel including the auxiliary hoist rope sheave assembly of this invention.

Before one embodiment of the invention is explained in detail, it is to be understood that the invention is not limited in its application to the details of the construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting. Use of "including" and "comprising" and variations thereof as used herein is meant to encompass the items listed thereafter and equivalents thereof as well as additional items. Use of "consisting of" and variations thereof as used herein is meant to encompass only the items listed thereafter and equivalents thereof. Further, it is to be understood that such terms as "forward", "rearward", "left", "right", "upward" and "downward", etc., are words of convenience and are not to be construed as limiting terms.

DETAILED DESCRIPTION OF THE PREFERRED EMBODIMENT

As illustrated in the drawings, this invention provides mining equipment in the form of an electric shovel 10 including a revolving frame 14, and a boom 18 having two ends, with one end 22 attached to the revolving frame 14. In other embodiments, other equipment, such as a dragline (not shown) could be used. The boom 18 has a mid point 26 between the two ends. The shovel 10 also includes a handle 30 movable mounted on the boom 18, a dipper 34 attached to the end of the handle 30, and a boom point sheave 38 rotatably mounted near the other end 40 of the boom 18.

Figure 2:
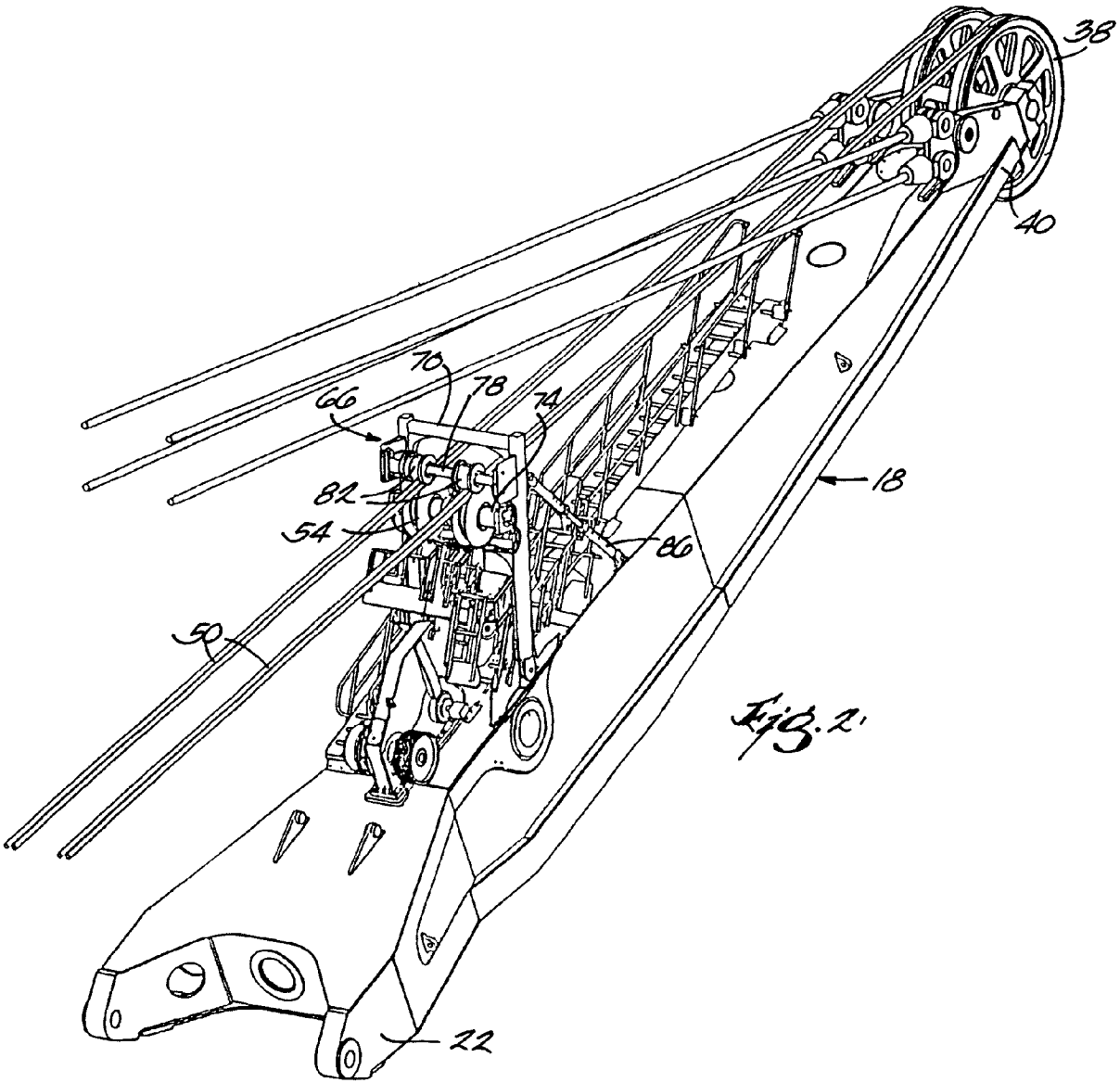
FIG. 2 is a perspective view of the boom and auxiliary hoist rope sheave assembly shown in FIG. 1.

The shovel 10 further includes a hoist rope drum 42 mounted on the revolving frame 14, driven through a gearbox 46 attached to the revolving frame 14, and a hoist rope 50 that extends from the hoist rope drum 42 along the boom 18 and over the hoist sheave 54. More particularly, as shown in FIG. 2, there are two pairs of two hoist ropes 50. The part of the hoist rope 50 that extends from the hoist rope drum 42 to the hoist sheave 54 is referred to as the rope span, and the middle of the span is referred to as the mid span.

Figure 3:
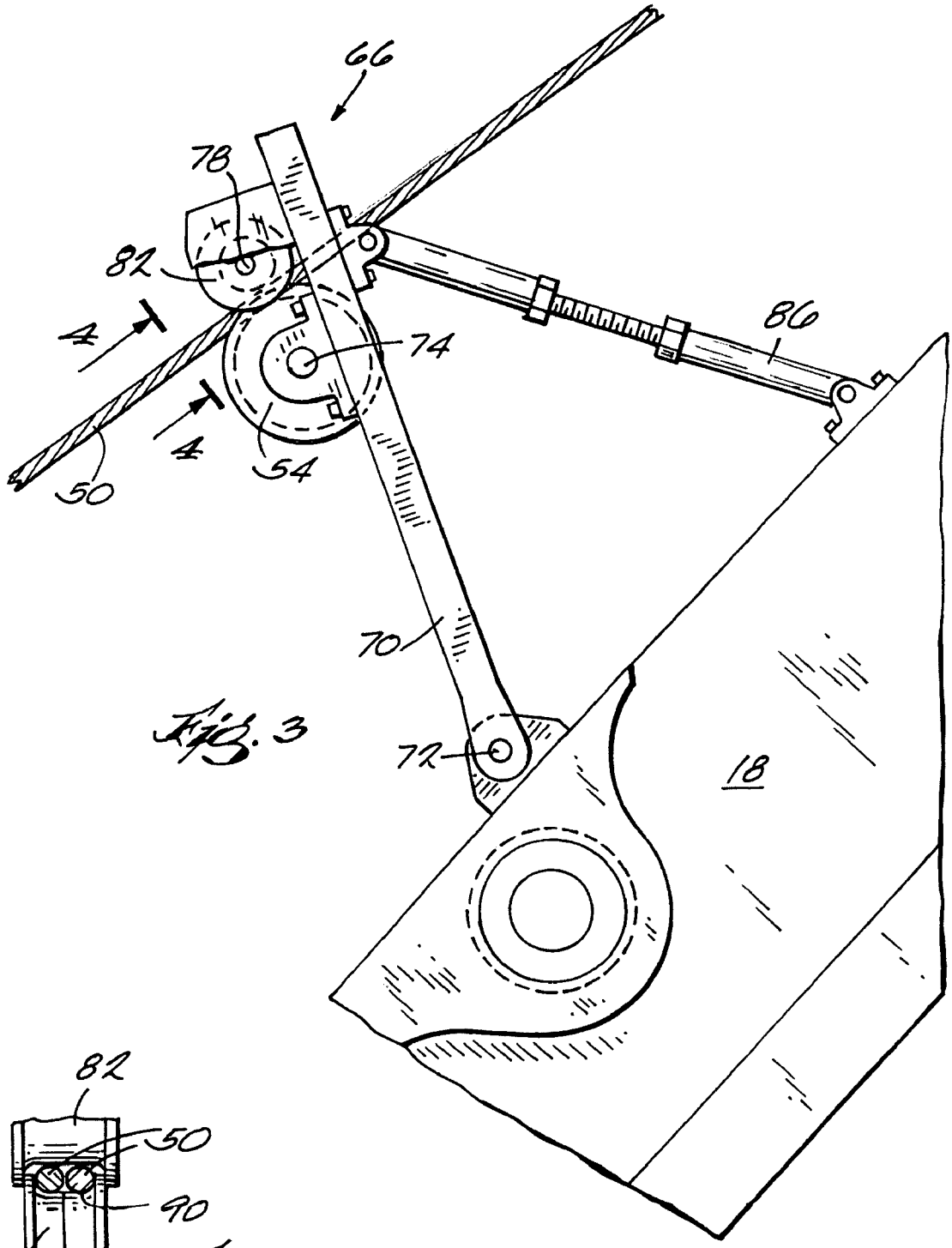
FIG. 3 is a side view of the auxiliary hoist rope sheave assembly.
Figure 4:
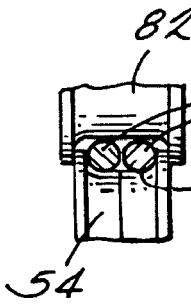
FIG. 4 is a cross sectional view of two hoist ropes, one sheave and one roller as taken along the line 4—4 in FIG. 3.

The shovel 10 of this invention further includes an auxiliary hoist sheave assembly 66. More particularly, as shown in FIGS. 2, 3 and 4, the auxiliary hoist sheave assembly 66 comprises a welded tubular frame or sheave support frame 70, and means for mounting the tubular frame 70 to near the mid point of the boom 18 and near the mid span of the hoist ropes 50. Still more particularly, as shown in FIG. 3, the tubular frame is pin 72 mounted to the boom 18.

The auxiliary hoist sheave assembly 66 further includes a lower fleeting steel sheave shaft 74, an upper guide roller steel shaft 78, both of which are attached horizontally but spaced apart to the support frame 70 by brackets, and two dual grooved (see FIG. 4) fleeting hoist sheaves 54, rotatably supported by the lower fleeting sheave shaft 74. The fleeting hoist sheaves 54 are in contact with the hoist rope 50, and the fleeting hoist sheaves 54 fleet side to side as the hoist ropes 50 follow the hoist drum grooving (not shown). The auxiliary hoist sheave assembly 66 further includes two split nylon guide rollers 82 that also fleet side to side with the hoist sheaves 54 and that are rotatably mounted on the upper guide roller shaft 78. Each of the hoist ropes 50 is located between one of the guide rollers 82 and one of the fleeting hoist sheaves 54. Thus, the guide roller 82 constrains the hoist ropes so that the ropes remain within the grooves of its respective hoist sheave 54.

The auxiliary hoist sheave assembly 66 further includes means for adjusting the height of the sheaves 54, by adjusting the pivot position of the support frame 70, in the form of two adjustable turnbuckle-style struts 86, each of which is pivotally attached to each of and between the boom 18 and the sheave support frame 70. In other embodiments, not shown, the turnbuckle can be included in each leg of the support frame 70. Further, the upper and lower shafts 78 and 74, respectively, can be mounted via a mechanism (not shown) for adjustable positioning the shafts on the support frame 70.

Various other features and advantages of the invention will be apparent from the following claims.

The invention claimed is:

1. A mining machine including a revolving frame, a boom having two ends, with one end attached to the revolving frame, the boom having a mid point between said two ends, a dipper attached to the end of a handle, a boom point sheave rotatably mounted near the other end of the boom, a hoist rope drum mounted on the revolving frame, a hoist rope that extends from the hoist rope drum along the boom and over the boom point sheave, referred to as the rope span, the middle of the span being referred to as the mid span, said hoist rope being attached to said dipper, and an auxiliary hoist sheave assembly comprising:

a sheave support frame, means for mounting the sheave support frame to the boom midpoint, a sheave shaft mounted on said sheave support frame, an upper guide roller shaft mounted on said sheave support frame, spaced apart from but parallel to said sheave shaft, a grooved hoist sheave, rotatably supported by and slidable along the sheave shaft, said hoist sheave being in contact with said hoist rope, and said hoist sheave fleeting side to side along said sheave shaft as the hoist rope follows the hoist drum, and a guide roller rotatably mounted on and slidable along the upper guide roller shaft, said hoist rope being constrained to remain in said hoist sheave by said guide roller.

2. An mining machine including a revolving frame, a boom having two ends, with one end attached to the revolving frame, the boom having a mid point between said two ends, a handle movably mounted on the boom, a dipper attached to the end of the handle, a boom point sheave rotatably mounted near the other end of the boom, a hoist rope drum mounted on the revolving frame, a hoist rope that extends from the hoist rope drum along the boom and over the boom point sheave, referred to as the rope span, the middle of the span being referred to as the mid span, said hoist rope being attached to said dipper, and an auxiliary hoist sheave assembly comprising:

a sheave support frame, means for pivotally mounting the sheave support frame to the boom, a lower sheave shaft mounted on said sheave support frame, an upper guide roller shaft mounted on said sheave support frame, spaced apart from but parallel to said lower sheave shaft, a hoist sheave, rotatably supported by and slidable along the lower sheave shaft, said hoist sheave being in contact with said hoist rope, and said hoist sheave fleeting side to side along said lower sheave shaft as the hoist rope follows the hoist drum, a guide roller rotatably mounted on and slidable along the upper guide roller shaft, said hoist rope being constrained to remain in said hoist sheave by said guide roller, and means for adjusting the height of the sheaves relative to said boom.

3. A mining machine in accordance with claim 2 wherein there are two spaced apart sets of two hoist ropes.

4. A mining machine in accordance with claim 2 wherein there are two dual grooved hoist sheaves.

5. A mining machine in accordance with claim 2 wherein there are two guide rollers.

6. A mining machine in accordance with claim 2 wherein said sheave support frame is a welded tubular frame.

7. A mining machine in accordance with claim 2 wherein said guide roller is made from nylon.

8. A mining machine in accordance with claim 2 wherein said means for adjusting the height of the sheaves relative to said boom is an adjustable turnbuckle strut that is attached between the boom and the sheave support frame.

9. An auxiliary hoist sheave assembly adapted to be mounted on mining equipment including a revolving frame, a boom having two ends, with one end attached to the revolving frame, the boom having a mid point between said two ends, a boom point sheave rotatably mounted near the other end of the boom, a hoist rope drum mounted on the revolving frame, a hoist rope that extends from the hoist rope drum along the boom and over the hoist sheave, referred to as the rope span, the middle of the span being referred to as the mid span, and the hoist ropes being attached to a dipper, said auxiliary hoist sheave assembly comprising:

a sheave support frame adapted to be connected to the boom midpoint, means for pivotally mounting the sheave support frame to the boom near the boom midpoint and near the hoist rope mid span, a lower sheave shaft mounted on said sheave support frame, an upper guide roller shaft mounted on said sheave support frame, spaced apart from but parallel to said lower sheave shaft, a grooved hoist sheave, rotatably supported by and slidable along the lower sheave shaft, said hoist sheave being in contact with said hoist rope, and said hoist sheave fleeting side to side along said lower sheave shaft as the hoist rope follows the hoist drum, a guide roller rotatably mounted on and slidable along the upper guide roller shaft, said hoist rope being constrained to remain in said hoist sheave groove by said guide roller, and means for adjusting the height of the sheaves relative to said boom.

* * * * *